US006893061B2

(12) United States Patent
Miller et al.

(10) Patent No.: US 6,893,061 B2
(45) Date of Patent: May 17, 2005

(54) METHODS AND APPARATUS FOR SECURING A DISHWASHER DOOR

(75) Inventors: Gregory Owen Miller, Louisville, KY (US); Christopher Raymond Geisen, Louisville, KY (US); Wenfeng Lu, Mason, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,877

(22) Filed: Oct. 26, 2001

(65) Prior Publication Data

US 2003/0030288 A1 Feb. 13, 2003

Related U.S. Application Data

(63) Continuation-in-part of application No. 09/682,255, filed on Aug. 9, 2001, now Pat. No. 6,761,381.

(51) Int. Cl.[7] ..... E05C 19/00

(52) U.S. Cl. ..... 292/303; 292/85; 292/87; 292/89; 292/121; 292/122; 292/DIG. 53; 292/DIG. 71

(58) Field of Search ..... 292/121, 303, 292/95, 122, DIG. 53, 109, DIG. 69, 85, 87, 89, 80, 81; D32/2, 3

(56) References Cited

U.S. PATENT DOCUMENTS 512,517 A * 1/1894 Ottenheimer ..... 292/80
1,075,367 A * 10/1913 Merritt ..... 292/99
2,948,560 A * 8/1960 Rop ..... 292/45
3,328,062 A * 6/1967 Geiger et al. ..... 292/123
3,415,961 A * 12/1968 Barnard ..... 200/61.64
3,841,677 A * 10/1974 Guth ..... 292/335
3,924,085 A * 12/1975 Stone ..... 200/61.62
3,997,201 A 12/1976 DeSchaaf et al.
4,105,229 A 8/1978 Kaldenberg
4,186,287 A 1/1980 Scott
4,776,620 A * 10/1988 Marks et al. ..... 292/228
4,917,414 A 4/1990 Boulanger
5,168,621 A 12/1992 Kruck et al.
5,174,618 A * 12/1992 Kropf ..... 292/254
5,234,238 A * 8/1993 Takimoto ..... 292/216
5,374,118 A 12/1994 Kruck et al.
5,810,403 A 9/1998 Prada

* cited by examiner

*Primary Examiner*—Daniel P. Stodola
*Assistant Examiner*—Carlos Lugo
(74) *Attorney, Agent, or Firm*—George L. Rideout, Esq.; Armstrong Teasdale LLP

(57) ABSTRACT

A latch assembly for a door including a door retainer projection is provided. The latch assembly includes a handle pivotally mounted to the door for rotation about a first end, and a latch actuator contacting the handle and mounted to the door for rotation about a first end. The handle rotates in one direction when actuated and the latch actuator rotates in a second direction opposite the first direction. A keeper is engaged to the door retainer projection in a closed position, and the latch actuator is configured to disengage the keeper from the door retainer projection when the handle is actuated.

14 Claims, 7 Drawing Sheets

METHODS AND APPARATUS FOR SECURING A DISHWASHER DOOR

CROSS REFERENCE TO RELATED APPLICATIONS

This application is a continuation-in-part application of U.S. application Ser. No. 09/682,255 filed Aug. 9, 2001 now U.S. Pat. No. 6,761,381.

BACKGROUND OF INVENTION

This invention relates generally to door latches, and more particularly, to methods and apparatus for securing an appliance door in a closed position.

At least some known dishwashers include a hinged door and a latch assembly that prevents the dishwasher from operating unless the door is latched in a closed position. To facilitate dishwasher operation, the latch assembly performs several different functions, including, securing the door to the tub assembly in a closed position, interrupting dishwasher operations when the door is opened, and restoring dishwasher operations when the door is returned to a closed position.

To perform such functions, at least some known latch assemblies include a plurality of stationary and moving components which interact with each other. However, because of the number and complexity of components, assembly of such latch assemblies may be a costly and time consuming process.

SUMMARY OF INVENTION

In one aspect, a latch assembly for a door including a door retainer projection is provided. The latch assembly comprises a handle pivotally mounted to the door for rotation about a first end, and a latch actuator contacting said handle and mounted to the door for rotation about a first end. The handle rotates in one direction when actuated and said latch actuator rotates in a second direction opposite the first direction. A keeper is engaged to the door retainer projection in a closed position, and the latch actuator configured to disengage said keeper from the door retainer projection when said handle is actuated.

In another aspect, a door latch assembly for an appliance is provided. The door assembly comprises a door, a latch handle pivotally mounted to said door, and a latch actuator pivotally mounted to said door. The latch handle pivots in one direction, and the latch actuator pivots in another direction. The handle selectively positionable between an open position and a closed position to couple said door to the appliance.

In a further another aspect, a dishwasher is provided that comprises a tub assembly comprising a keeper attached thereto and a door assembly comprising a door retainer portion for engagement with said keeper. A latch handle is pivotally coupled to said door assembly for rotation about a first longitudinal axis, and a latch actuator is pivotally coupled to said door assembly for rotation about a second longitudinal axis. The latch handle and said latch actuator are rotationally coupled to one another, and said latch actuator disengages said keeper from said door retainer projection as said handle is rotated.

In still another aspect, a door assembly for a dishwasher is provided. The door assembly comprises an escutcheon, a latch handle pivotally mounted to said escutcheon about a first rotational axis, and a latch actuator pivotally mounted to said escutcheon about a second rotational axis. The latch handle contacts said latch actuator when rotated about said first longitudinal axis in a first direction and causes said latch handle to rotate about said second longitudinal axis in a second direction opposite said first direction.

In yet another aspect, a dishwasher is provided. The dishwasher comprises a tub assembly comprising a keeper attached thereto, a door assembly comprising a bracket and a door retainer projection for engaging said keeper, a latch handle hingedly coupled to said bracket, said latch handle selectively positionable about a first longitudinal axis, and a latch actuator hingedly coupled to said bracket and rotatable about a second longitudinal axis. The latch actuator is in contact with said latch handle, and a position of said latch actuator is determined by a position of said latch handle. The latch handle is positionable to disengage said keeper from said door retainer projection with said latch actuator.

DETAILED DESCRIPTION

Figure 1:
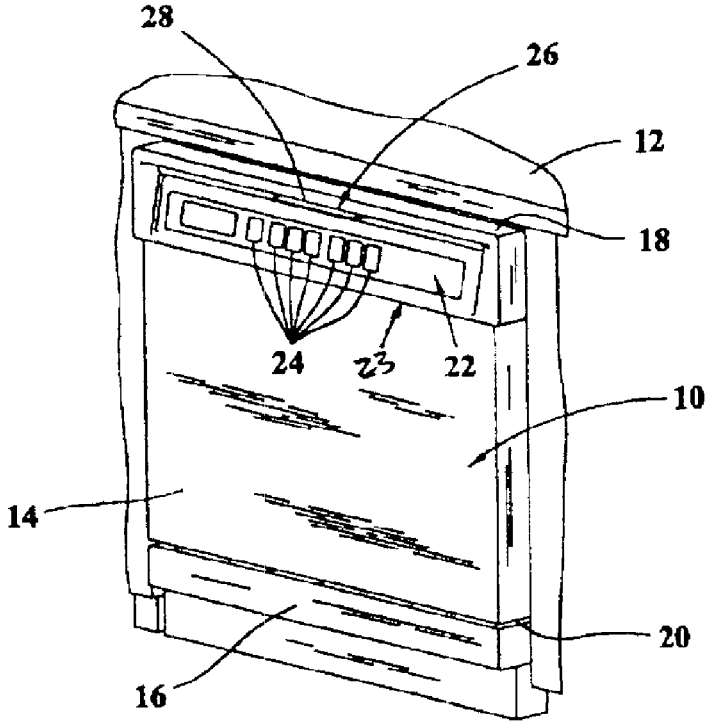
FIG. 1 is a perspective view of an under-the-counter type dishwasher with portions of the counter cut away.

FIG. 1 is a perspective view of an under-the-counter type dishwasher 10 installed beneath a counter 12. Dishwasher 10 includes a door 14 and a base 16. Door 14 includes an upper edge 18 and a lower edge 20 which is hingedly coupled to base 16. A control panel 22 including a plurality of controls 24 is secured to an upper portion of door 14. In an exemplary embodiment, control panel 24 is secured to an escutcheon 23 which, in turn, is mounted to an upper portion of door 14. In an alternative embodiment control panel 24 is integrated directly into door 14. Dishwasher 10 also includes a latch assembly 26 for opening and closing door 14 relative to base 16. In the exemplary embodiment, latch assembly 26 includes a handle 28.

In use, an operator depresses handle 28 to open door 14. If dishwasher 10 is in operation, operation is interrupted, or is prevented, until door 14 is returned to a closed position. Door 14 can then be freely opened for loading or unloading dishes. To enable operations, an operator simply closes door 14 to re-engage latch assembly 26 such that door 14 is secured in a closed position.

Figure 2:
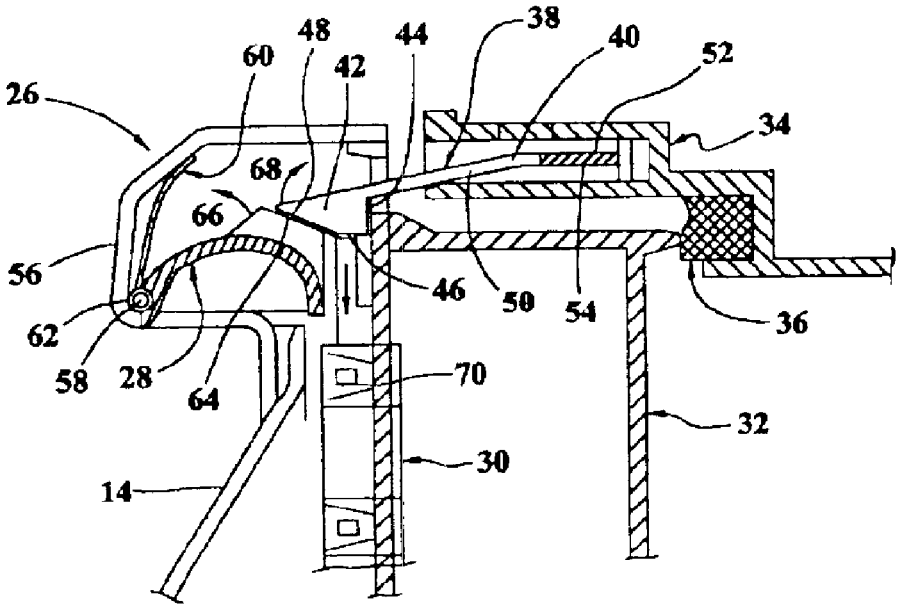
FIG. 2 is a partial cross-sectional view of the latch assembly shown in FIG. 1 in a closed position.

FIG. 2 is a partial cross-sectional view of latch assembly 26 (shown in FIG. 1) mounted to dishwasher door 14 (shown in FIG. 1). More specifically, FIG. 2 illustrates dishwasher door 14 and latch assembly 26 in a closed position. Dishwasher door 14 includes an outer wall 30 and an inner wall 32. Dishwasher 10 (shown in FIG. 1) also includes a tub assembly 34 that includes a gasket 36. Gasket 36 engages to inner wall 32 to form a seal between door 14 and tub assembly 34 when door 14 is secured in a closed position.

In an exemplary embodiment, latch assembly 26 includes a keeper 38 attached to tub assembly 34. In one embodiment, keeper 38 is formed integrally with tub assembly 34. Keeper 38 includes a biasing member 40 and a head 42. In one embodiment, biasing member 40 is formed unitarily with head 42. Alternatively, biasing member 40 and head 42 are separate components. In an exemplary embodiment, biasing member 40 and head 42 are formed integrally. Head 42 includes a catch 44, a switch actuator 46, and a lock release projection 48. In one embodiment, biasing member 40 and head 42 are formed from a metallic material. In another embodiment, biasing member 40 and head 42 are formed from a non-metallic material. Biasing member 40 has a thickness 50 that is measured between a top surface 52 and a bottom surface 54 of biasing member 40. Thickness 50 is variably selected such that keeper 38 has a pre-determined flexibility to facilitate opening and closing of the door 14.

In the exemplary embodiment, latch assembly 26 also includes handle 28, a handle retainer 56, and a hinge pin 58. In one embodiment, handle 28 includes a biasing member 60, at least one pivot arm 62, and a handle contact surface 64. Pivot arm 62 is substantially circular and includes at least one opening therein for mating with hinge pin 58. In one embodiment, handle retainer 56 is secured in a stationary position. In another embodiment, handle 28 is rotatably coupled to handle retainer 56 using hinge pin 58. In a further embodiment, handle 28 is frictionally attached to handle retainer 56 without using hinge pin 58. Handle 28 and hinge pin 58 are rotatably coupled such that handle 28 rotates in a first direction 66. In one embodiment, handle 28 is formed unitarily with biasing member 60, and biasing member 60 is slidably coupled with handle retainer 56. Alternatively, handle 28 and biasing member 60 are separate components. In a further embodiment, handle 28, handle retainer 56, hinge pin 58, biasing member 60, pivot arm 62, and contact surface 64 are fabricated from a plastic material. Alternatively, at least one of handle 28, handle retainer 56, hinge pin 58, biasing member 60, pivot arm 62, and contact surface 64 is fabricated from a non-plastic material.

In use, handle 28 and keeper 38, are in a first position such that a switch 70 is in a closed state, keeper 38 is securing door 14 to tub assembly 34, and dishwasher operations are enabled. When handle 28 rotates in first direction 66, contact surface 64 makes sliding contact with lock release projection 48. Such contact causes keeper 38 to rotate in a second direction 68 that is opposite from first direction 66, and dishwasher operations are interrupted.

Figure 3:
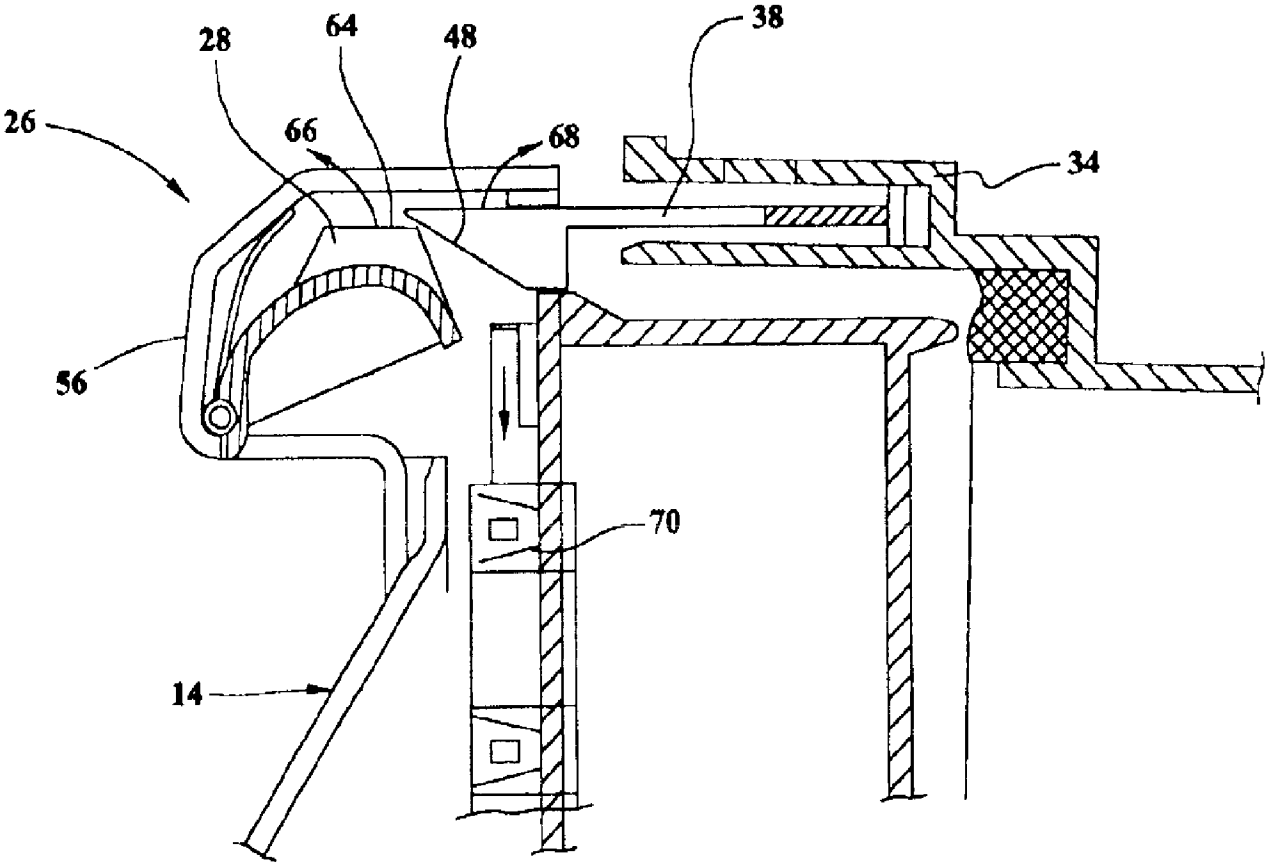
FIG. 3 is a partial cross-sectional view of the latch assembly shown in FIG. 1 in an open position.

FIG. 3 is a partial cross-sectional view, of latch assembly 26 (shown in FIG. 1) mounted to dishwasher door 14 (shown in FIG. 1). More specifically, FIG. 3 illustrates door 14 and latch assembly 26 in an open position.

In use, handle 28 and keeper 38, are in a first position such that switch 70 is in a closed state, keeper 38 is securing door 14 to tub assembly 34, and dishwasher operations are enabled. When handle 28 rotates in first direction 66, contact surface 64 makes slidable contact with lock release projection 48. Such slidable contact causes keeper 38 to rotate in a second direction 68 that is opposite from first direction 66. Keeper 38 then unsecures door 14 from tub assembly 34, switch 70 transitions from a closed state to an open state, and dishwasher operations are interrupted.

During assembly, latch assembly 26 is attached to dishwasher 10 and secures dishwasher door 14 to dishwasher tub assembly 34. Handle retainer 56 includes at least one substantially circular projection that frictionally connects handle 28 to handle retainer 56. Keeper 38 is attached to dishwasher tub assembly 34 such that keeper 38 is slidably coupled to handle 28.

Figure 4:
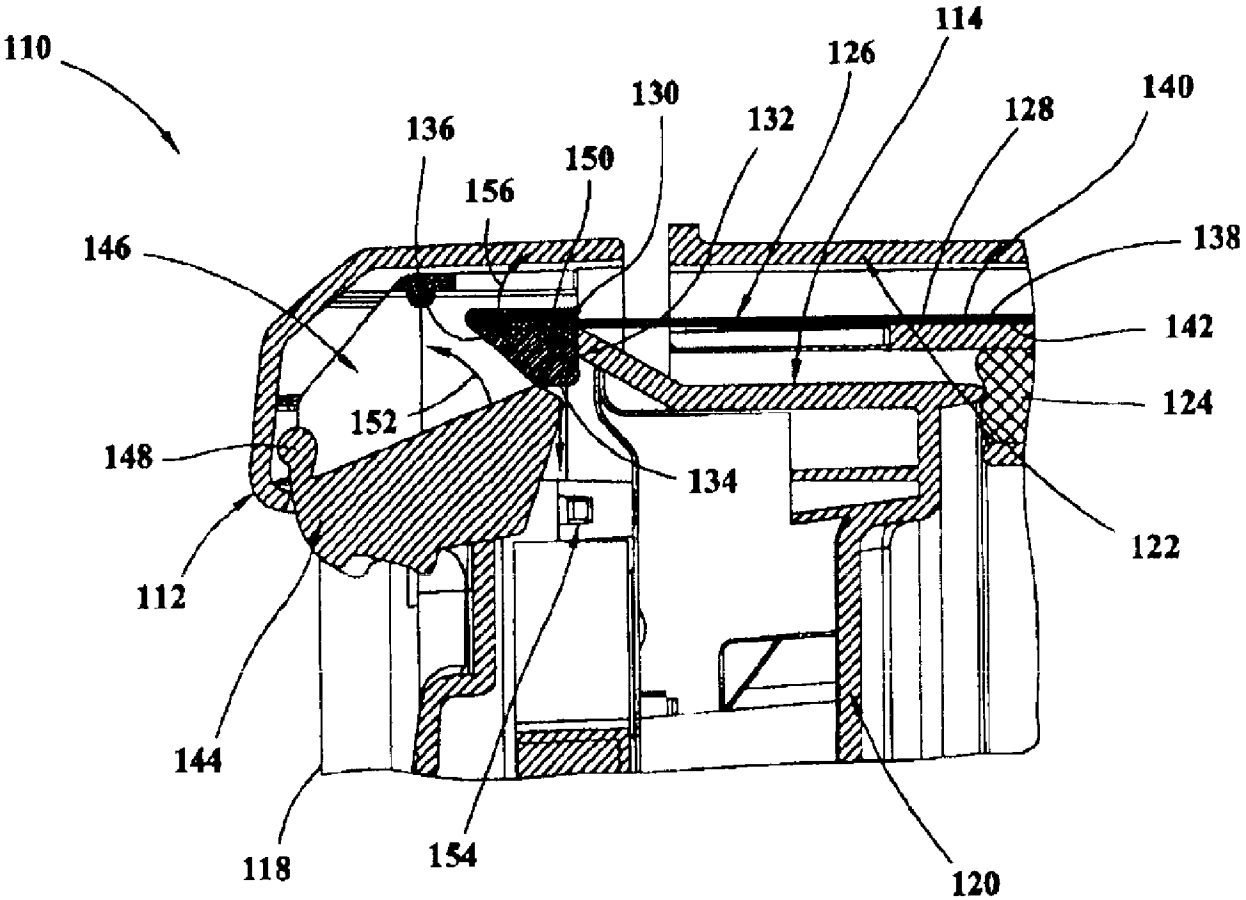
FIG. 4 is a partial cross-sectional view, of an alternative embodiment, of a latch assembly that may be used with the dishwasher shown in FIG. 1.

FIG. 4 is a partial cross-sectional view of an alternative embodiment of a latch assembly 110 that may be used with a dishwasher (not shown) such as dishwasher 10 shown in FIG. 1. Door 112 includes an upper edge 114 and a lower edge (not shown) which is hingedly coupled to a base (not shown). Dishwasher door 112 also includes an outer wall 118 and an inner wall 120. The dishwasher includes a tub assembly 122 including a gasket 124. Gasket 124 engages inner wall 120 to form a seal between door 112 and tub assembly 122 when door 112 is secured in a closed position.

In an exemplary embodiment, latch assembly 110 includes a keeper 126 attached to tub assembly 122. In one embodiment, keeper 126 is formed integrally with tub assembly 122. Keeper 126 includes a biasing member 128 and a head 130. In one embodiment, biasing member 128 is formed unitarily with head 130. In an exemplary embodiment, biasing member 128 is formed integrally with head 130. Alternatively, biasing member 128 and head 130 are separate components. Head 130 includes a catch 132, a switch actuator 134, and a lock release projection 136. In one embodiment, biasing member 128 and head 130 are formed from a metallic material. In another embodiment, biasing member 128 and head 130 are formed from a non-metallic material. Biasing member 128 also has a thickness 138 measured between a top surface 140 and a bottom surface 142 of biasing member 128. Thickness 138 is variably selected such that keeper 126 has a pre-determined flexibility to facilitate opening and closing door 112.

In the exemplary embodiment, latch assembly 110 also includes a handle 144, and a handle retainer 146. In one embodiment, handle 144 includes at least one pivot arm 148, and a contact surface 150. Pivot arm 148 is substantially circular and includes at least one opening therein for mating with handle retainer 146. In one embodiment, handle retainer 146 frictionally retains handle 144. In an alternative embodiment, handle 144 is pivotally attached to handle retainer 146 with a hinge pin (not shown). Handle retainer 146 and handle 144 are rotatably coupled such that handle 144 rotates in a first direction 152. In one embodiment, contact surface 150 includes a substantially planar surface and lock release projection 136 includes a substantially planar surface, such that contact surface 150 planar surface and lock release projection 136 planar surface are in slidable contact. In one embodiment, handle 144, handle retainer 146, pivot arm 148, and contact surface 150 are formed from a plastic material. In an alternative embodiment, at least one of handle 144, handle retainer 146, pivot arm 148, and contact surface 150 is formed from a non-plastic material.

In use, handle 144 and keeper 126, are in a first position such that a switch 154 is in a closed state, keeper 126 is securing door 112 to tub assembly 122, and dishwasher operations are enabled. When handle 144 rotates in first direction 152, contact surface 150 makes sliding contact with lock release projection 136. Such contact causes keeper 126 to rotate in a second direction 156 that is opposite from first direction 152. Keeper 126 unsecures door 112 from tub assembly 122, switch 154 transitions from a closed state to an open state, and dishwasher operations are interrupted.

The above described latch assembly includes a keeper, a handle retainer, and a handle attached to the handle retainer such that the handle slidably couples with the keeper to open or close the door. The latch assembly uses fewer components than other known latch assemblies, and is thus less complex than other known latch assemblies. As a result, assembly of the latch assembly is facilitated to be more cost effective and less time consuming.

Figure 5:
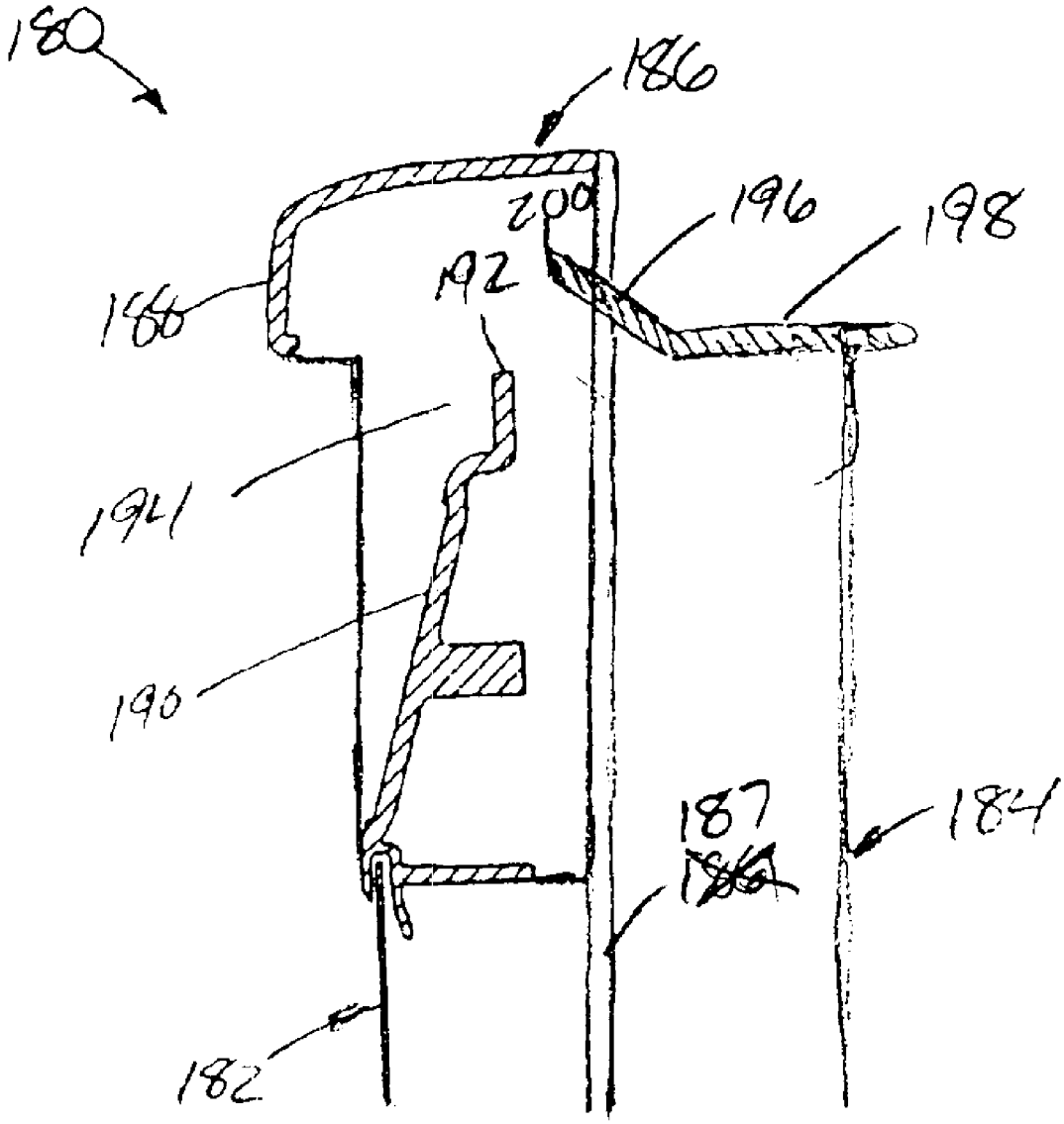
FIG. 5 is a cross sectional schematic view of a position of the door shown in FIG. 1.

FIG. 5 is a cross sectional schematic view of an illustrative embodiment of a portion of a dishwasher door assembly 180 through a plane wherein the above-described latch assembly 180 is located but with the latch assembly removed. Door assembly 180 may, for example, be incorporated into door 14 (shown in FIG. 1) and used with one of the foregoing latch assemblies, such as, for example, latch assembly 110 (shown in FIG. 4). Door assembly 180 includes an outer door panel 182, an inner door panel 184, and an escutcheon 186 attached to outer door panel 182 and inner door panel 184. Each of inner door panel and outer door panel 184, 182, in an exemplary embodiment, are formed into shallow box-like structures attached to one another at a seam 187 with known fasteners and fastening techniques. In one embodiment, each panel 182, 184 includes four lateral sides extending from one another in a rectangular configuration, and attachment flanges extend substantially perpendicularly to respective lateral sides of the panels for attachment to one another at seam 187. As such, a sturdy but hollow door frame is provided by door panels 182, 184.

Escutcheon 186 is mounted to door panels 182, 184 and includes a rounded hood portion 188 and an inclined control panel mounting surface 190 extending beneath hood portion 188 to protect surface 190 from countertop spills and drips. In the illustrated embodiment, control mounting surface 190 extends from an upper portion of door outer panel 182 and is inwardly inclined to form a recessed control panel mounting surface, and hood portion 188 overhangs door outer panel 182.

A latch handle portion 192 extends from control mounting surface 190, extends substantially parallel to an outer surface of door panel 182, and is further set back from control panel mounting surface 190 to provide an extended recess 194 for manipulation of a latch assembly handle, such as handle 144 (shown in FIG. 4) and further upon which a portion of the handle rests when the handle is in a closed position. A door retainer projection 196 extends from an upper edge 198 of inner door panel 184 and protrudes beneath escutcheon hood 188 such that a distal end 200 of door retainer portion is positioned above escutcheon latch handle portion 192. Thus, as door assembly 180 is opened and closed, door retainer projection 196 engages with and disengages from a latch keeper, such as those described above, to securely latch and unlock door assembly 180 as desired.

Figure 6:
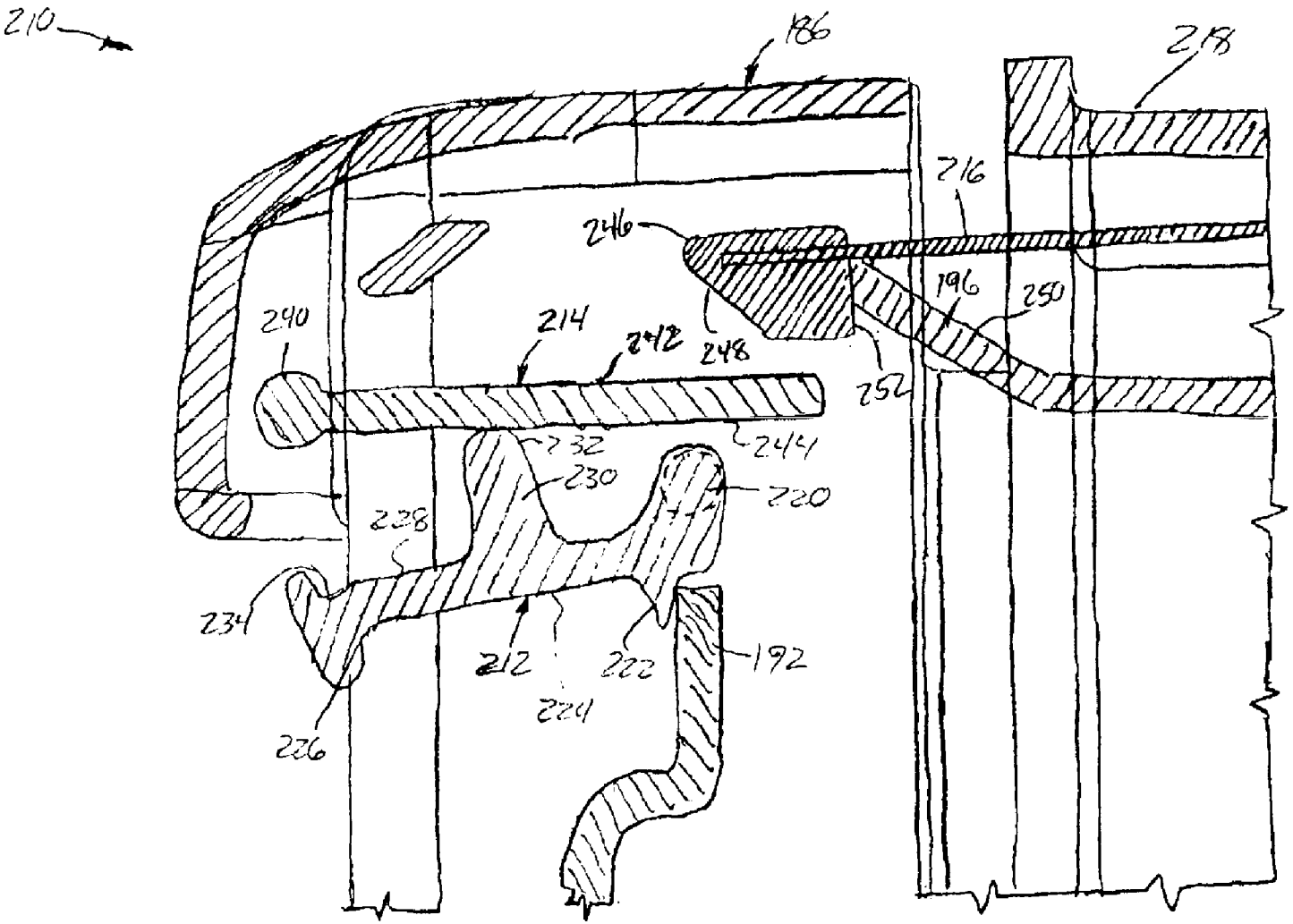
FIG. 6 is a cross sectional schematic of a third embodiment of a door latch assembly.

FIG. 6 is a cross sectional schematic of a third embodiment of a door latch assembly 210 in a closed position. Latch assembly 210 may be used, for example, with door assembly 180 (shown in FIG. 5) and includes a latch handle 212 and a latch actuator 214 each pivotally mounted to a bracket (not shown in FIG. 6) that is attached to escutcheon 186. Latch handle 212 and latch actuator 214 cooperate with a keeper 216 attached to a dishwasher tub assembly 218. Keeper 216 engages door retainer projection 196 to maintain the dishwasher door in a sealed closed position for dishwasher operation. A door switch (not shown) is also included in latch assembly 210 and is maintained in a closed position or an open position according to a position of the door to signal a dishwasher control unit of a door closed or door open condition, respectively.

Latch handle 212 is pivotally mounted at a first end 220 just above and substantially aligned with escutcheon latch portion 192, and latch handle 212 is biased into the closed (not shown in FIG. 6). A closed handle stop portion 222 extends downwardly from handle latch first end 220 and contacts an upper edge of escutcheon latch portion 192 to seat handle 212 in a closed position. A substantially flat lower gripping surface 224 extends from handle stop portion 222 for hand manipulation by a user, and a lip 226 extends downwardly from handle gripping surface 224 to facilitate hand manipulation of latch handle 212. Latch handle 212 further includes an actuator surface 228 extending opposite gripping surface 224 and also extending from handle first end 220. Actuator surface 228 includes a raised actuator portion 230 extending upwardly toward, and in sliding engagement with, handle actuator 214. Actuator portion 230 includes a rounded upper end 232 providing smooth rolling engagement with handle actuator 214. Actuator surface 228 further includes a rounded stop portion 234 extending opposite lip 226 that engages latch actuator 214 when handle 212 is in a fully opened position, described below.

Thus, to operate latch assembly 210, latch handle 212 is rotated (clockwise in FIG. 2) about first end 220 and against the action of the handle latch bias element until latch handle stop portion 234 contacts latch actuator 214. When latch handle 212 is released by a user, latch handle 212 is returned by the bias element to the closed position wherein handle closed stop portion 222 contacts escutcheon latch portion 192.

Latch actuator 214 includes a rounded first end 240 that is pivotally mounted to escutcheon 186 and substantially straight and parallel surfaces 242, 244 extending therefrom. Surface 244 engages latch handle actuator portion 230 in the closed position, and surface 242 engages a head 246 of keeper 216 to disengage keeper 216 from door retainer projection 196 as latch assembly 210 is manipulated by a user to open the dishwasher door.

More specifically, as latch handle 212 is rotated (clockwise in FIG. 2) about latch handle first end 220, latch handle actuator portion 230 is displaced upwardly toward latch actuator 214. As latch handle actuator portion rounded end 232 engages handle actuator lower surface 244, handle actuator 214 is pivoted (counterclockwise in FIG. 6) about latch actuator first end 240 until handle actuator upper surface 242 contacts keeper head 246. Rotation of latch handle 212 and latch actuator 214 continues until latch handle stop portion 234 contacts latch actuator rounded end 240 such that latch handle actuator portion 230, latch actuator 214, and keeper head 246 are fully displaced and keeper head 246 is fully disengaged from door retainer projection 196. As such, the door may be opened with a relatively small outward force applied (to the left in FIG. 6) to latch handle 226.

When latch handle 212 is released, latch handle 212 returns to the closed position and closed handle stop portion 222 abuts escutcheon latch portion 192. In one embodiment, latch actuator 214 is also biased into a closed position with a known bias element, such a torsion coil spring (not shown), such that latch actuator lower surface 244 is engaged to latch handle actuator portion 230.

As the door is closed, an inclined guide surface 248 of keeper head 246 contacts an upper edge 250 of door retainer projection 196 and keeper head 246 is displaced upwardly over door retainer projection 196 against the bias of keeper 216. Once keeper head 246 clears an end of door retainer projection 196 as the door is shut, the bias of keeper 216 returns keeper head 246 to a downward position wherein a keeper catch surface 252 is firmly engaged to door retainer projections. As such, the door is firmly secured to the dishwasher cabinet and tub assembly 218.

Figure 7:
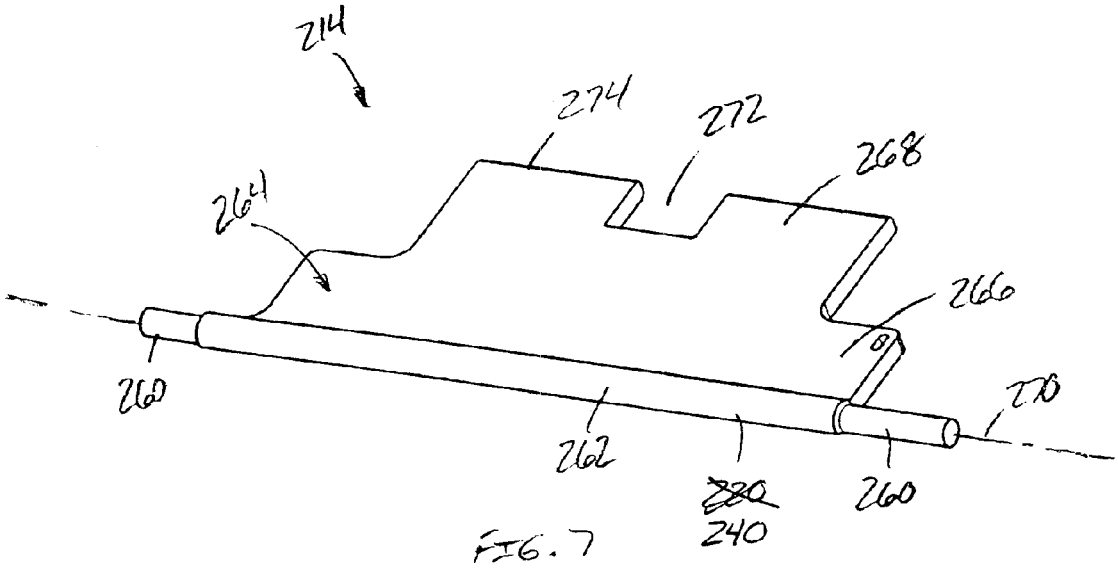
FIG. 7 is a perspective view of a handle actuator for the latch assembly shown in FIG. 6.

FIG. 7 is a perspective view of handle actuator 214 including a pin 260, a sleeve 262 surrounding pin 260 at first end 240 of actuator 214, and a generally flat plate 264 extending from sleeve 262. Plate 264 includes a base portion 266 extending immediately from sleeve 262, and a keeper engagement portion 268 extending from base portion 266. Base portion 266 extends for a first length along a longitudinal axis 270 through shaft 260, and keeper engagement portion 268 extends for a second length, less than the first length, along longitudinal axis 270. Keeper engagement portion 268 further includes a notch 272 or cutout portion at a distal end 274 thereof for accommodating a door switch (not shown) for actuation by keeper head 246 (shown in FIG. 6). Keeper engagement portion 268 contacts keeper head 246 (shown in FIG. 6) as latch assembly 210 is operated.

Figure 8:
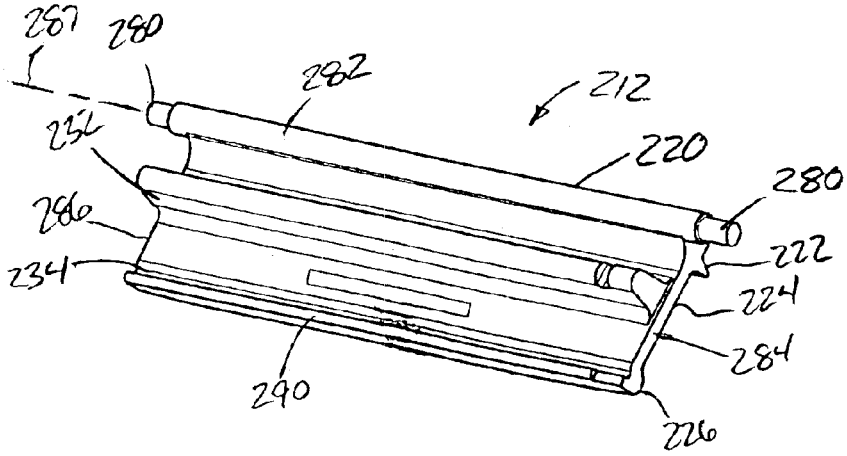
FIG. 8 is a perspective view of a latch handle for the door latch assembly shown in FIG. 6.

FIG. 8 is a perspective view of latch handle 212 including a pin 280, and a sleeve 282 surrounding pin 280 at a first end 220 of latch handle. Pin 280 extends from sleeve 282 beyond side edges 284, 286 of latch handle 212 along a pin longitudinal axis 287. Raised handle actuator portion 232 extends from side edge 284, 286 for engagement with latch actuator flat plate 264 (shown in FIG. 7). Handle rounded stop portion 234 extends from edge 284 to edge 286 at a distal end 290 extending opposite first end 220. Substantially flat gripping surface 224 extends beneath actuator portion 232, and handle lip 226 extends at distal end 290 from side edge 284 to side edge 286. Closed handle stop portion 222 extends from edge 284 to edge 286 slightly forward of and beneath sleeve 282.

Figure 9:
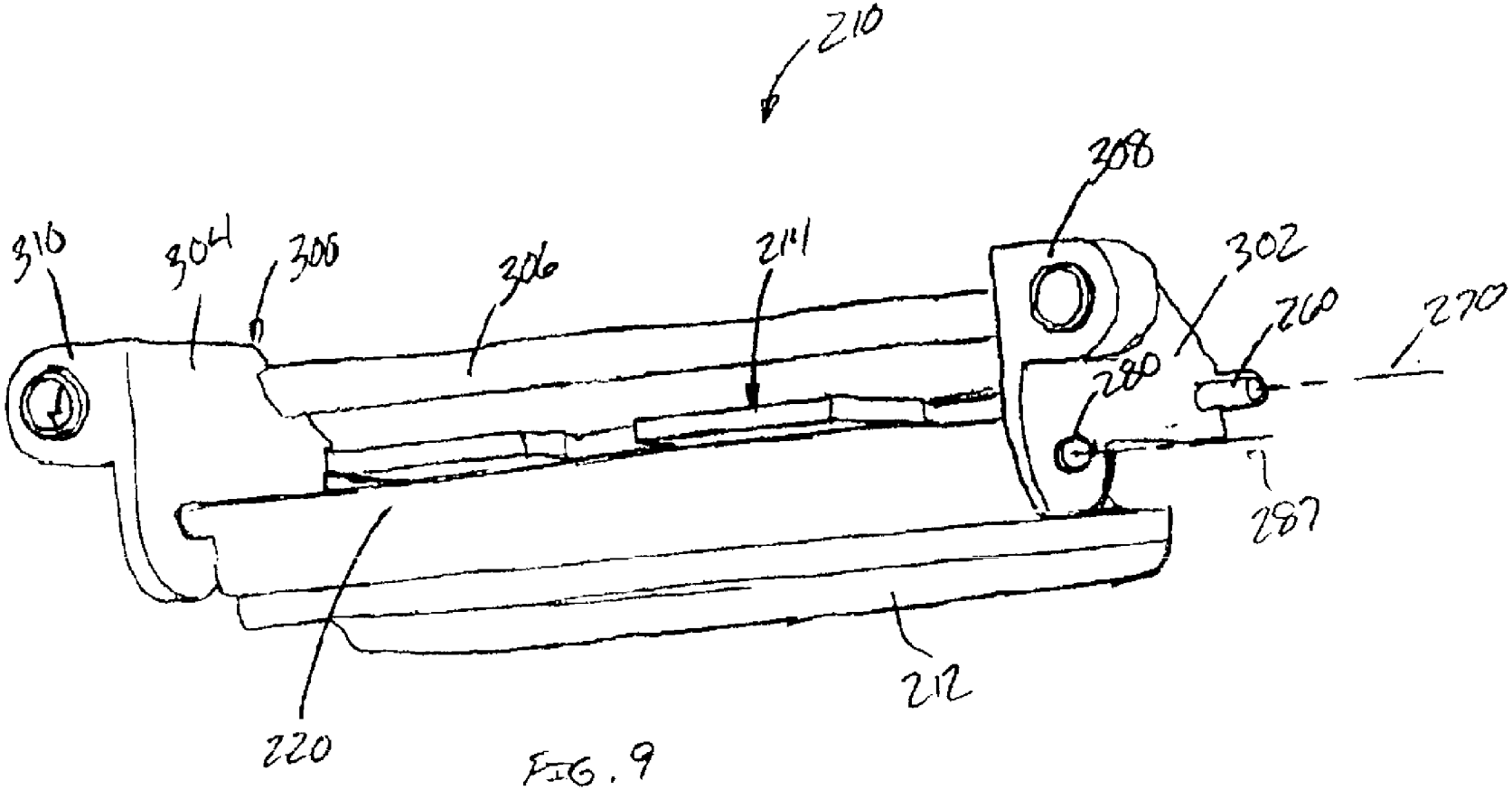
FIG. 9 is a perspective assembly view of a portion of the door latch assembly shown in FIG. 6.

FIG. 9 is a rear perspective assembly view of a portion of door latch assembly 210 including latch handle 212 and latch actuator 214 mounted to a bracket 300 including side fins 302, 304 and an upper cross member 306 extending therebetween for support and rigidity. Mounting formations 308, 310 extend from fins 302, 304 and bracket 300 to escutcheon 180 (shown in FIG. 5) or directly to a dishwasher door. Latch handle 212 and latch actuator 214 are hingedly mounted to bracket fins 302, 304 via respective pins 260, 280. Pins 260, 280 allow swinging movement of latch handle 212 and latch actuator 214 about respective pins 260, 280, and because respective longitudinal axis 270, 287 are displaced from one another, latch handle 212 and latch actuator 214 counter-rotate relative to one another about latch handle first end 220 and latch actuator first end 240 (shown in FIGS. 6 and 7). That is, as latch handle 212 rotates in one direction about first end 220, latch actuator 214 rotates in the opposite direction about first end 240 when latch actuator 214 and latch handle 212 are engaged to one another.

In an exemplary embodiment, bracket 300, latch handle 212 and latch actuator 214 are fabricated from durable plastic materials according to known techniques. It is contemplated, however, that a variety of fabrication processes and suitable fabrication materials, including but not limited to metals, metal alloys, and ceramic materials, may likewise be employed in alternative embodiments without departing from the scope and spirit of the present invention.

A latch assembly is therefore provided that latches and unlatches a dishwasher door with relative ease and a relatively simple and low cost construction.

While the invention has been described in terms of various specific embodiments, those skilled in the art will recognize that the invention can be practiced with modification within the spirit and scope of the claims.

What is claimed is:

1. A dishwasher door latch assembly for a dishwasher comprising:

a door comprising a door retainer projection and a rounded hooded portion;

a resilient keeper coupled to the dishwasher;

a latch handle pivotally mounted to said door beneath said rounded hooded portion, said latch handle disposed entirely within said hooded portion, said latch handle configured to rotate about a first longitudinal axis; and a latch actuator pivotally mounted to said door, said latch actuator configure to rotate about a second longitudinal axis, said latch handle and said latch actuator rotationally coupled, said latch handle pivoting in one direction, said latch actuator pivoting in another direction, said handle selectively positionable between an open position and a closed position to couple said door to the dishwasher, said latch actuator disengaging said resilient keeper from said door retainer projection as said latch handle is rotated.

2. A door latch assembly in accordance with claim 1 wherein the dishwasher further includes a tub assembly.

3. A door latch assembly in accordance with claim 1 wherein said keeper comprises a keeper engagement surface, said keeper engagement surface disengaging said keeper from door retaining projection as said latch handle is rotated.

4. A door latch assembly in accordance with claim 1 further comprising a bracket mounted to said door, said latch handle and said latch actuation hingedly attached to said bracket.

5. A latch assembly in accordance with claim 1, said latch handle comprising a rounded engagement portion in contact with said latch actuator.

6. A dishwasher comprising:

a tub assembly comprising a resilient keeper attached thereto;

a door assembly comprising a rounded hooded portion and a door retainer projection for engagement with said keeper;

a latch handle pivotally coupled to said door assembly for rotation about a first longitudinal axis, said latch handle disposed entirely within said hooded portion; and a latch actuator pivotally coupled to said door assembly for rotation about a second longitudinal axis, said latch handle and said latch actuator rotationally coupled to one another, said latch actuator disengaging said keeper from said door retainer projection as said handle is rotated.

7. A dishwasher in accordance with claim 6, said handle comprising an actuator portion in contact with said latch actuator.

8. A dishwasher in accordance with claim 6 further comprising a bracket, said latch handle and said latch actuator coupled to said bracket.

9. A dishwasher in accordance with claim 6 wherein said latch actuator comprises a substantially flat plate.

10. A dishwasher in accordance with claim 6, said latch handle comprising a closed handle stop.

11. A dishwasher door assembly, said door assembly comprising:

an escutcheon comprising a latch portion and a rounded hooded portion;

a latch handle pivotally mounted to said escutcheon beneath said rounded hooded portion about a first longitudinal axis, said latch handle disposed entirely within said hooded portion; and a latch actuator pivotally mounted to said escutcheon about a second longitudinal axis, said latch handle contacting said latch actuator when rotated about said first longitudinal axis in a first direction and causing said latch actuator to rotate about said second longitudinal axis in a second direction opposite said first direction.

12. A door assembly in accordance with claim 11, said latch handle comprising a closed handle stop portion contacting said latch portion in a closed position.

13. A door assembly in accordance with claim 11, said latch actuator comprising a substantially flat plate.

14. A dishwasher comprising:

a tub assembly comprising a resilient keeper attached thereto;

a door assembly comprising a bracket, a door retainer projection for engaging said keeper, and a rounded hooded portion;

a latch handle hingedly coupled to said bracket, said latch handle selectively positionable about a first longitudinal axis, said latch handle disposed entirely within said hooded portion; and a latch actuator hingedly coupled to said bracket and rotatable about a second longitudinal axis, said latch actuator in contact with said latch handle, a position of said latch actuator determined by a position of said latch handle, said latch handle positionable to disengage said keeper from said door retainer projection with said latch actuator.

* * * * *

UNITED STATES PATENT AND TRADEMARK OFFICE

CERTIFICATE OF CORRECTION

PATENT NO. : 6,893,061 B2
APPLICATION NO. : 09/682877
DATED : May 17, 2005
INVENTOR(S) : Miller et al.

It is certified that error appears in the above-identified patent and that said Letters Patent is hereby corrected as shown below:

Column 8, line 30, delete “latch actuation” and insert therefor -- latch actuator --.

Signed and Sealed this

Twenty-fourth Day of June, 2008

JON W. DUDAS
*Director of the United States Patent and Trademark Office*